United States Patent [19]

Timian

[11] 4,250,586

[45] Feb. 17, 1981

[54] VIBRATORY PAINT APPLICATOR AND SYSTEM

[76] Inventor: Martin R. Timian, 1518 7th St., Bremerton, Wash. 98310

[21] Appl. No.: 18,344

[22] Filed: Mar. 7, 1979

[51] Int. Cl.[3] ..... A46B 13/04

[52] U.S. Cl. ..... 15/22 R; 15/97 R; 15/98

[58] Field of Search ..... 15/97 R, 98, 22 R, 22 A, 15/50 A, 103

[56] References Cited

U.S. PATENT DOCUMENTS

| | | | |
|---|---|---|---|
| 1,461,708 | 7/1923 | Marcello | 15/97 R |
| 2,003,847 | 6/1935 | Woods | 15/98 X |
| 3,357,033 | 12/1967 | Sawyer | 15/98 |

FOREIGN PATENT DOCUMENTS

| | | | |
|---|---|---|---|
| 1914433 | 10/1970 | Fed. Rep. of Germany | 15/97 R |
| 287330 | 3/1953 | Switzerland | 15/98 |

*Primary Examiner*—Edward L. Roberts

*Attorney, Agent, or Firm*—Seed, Berry, Vernon & Baynham

[57] ABSTRACT

A paint applicator is disclosed for evenly spreading paint over a work surface, particularly an uneven work surface. A multi-cellular pad or sponge held by a pad holder is secured for vibratory movement to a manifold to which paint is delivered under pressure. Paint flows from the manifold and saturates the cellular pad. The arm of an electric vibrator or oscillator contacts the pad and imparts a vibratory or oscillatory motion to the pad. The vibrator or oscillator is supported in the housing secured to the manifold. The outer configuration of the housing may be shaped for gripping with the hand for paint application by an operator. Paint is delivered to the applicator from a pressurized container with the amount controlled by a flow control valve.

8 Claims, 6 Drawing Figures

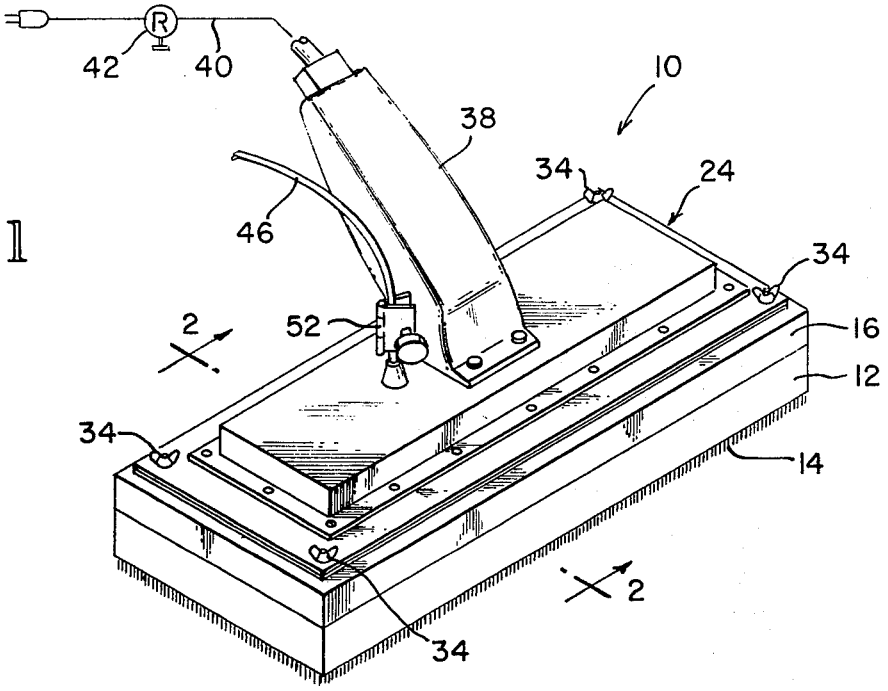
FIG. 1
FIG. 3
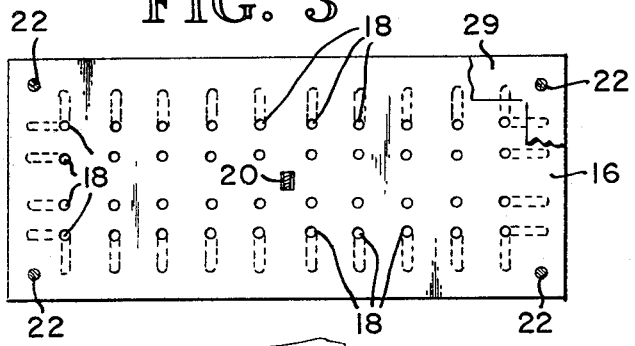
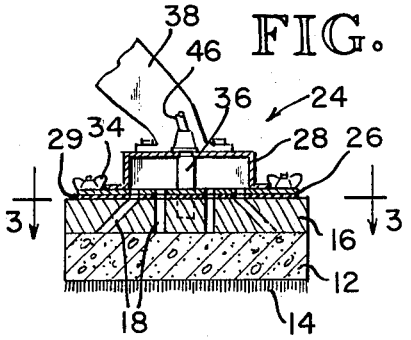
FIG. 2
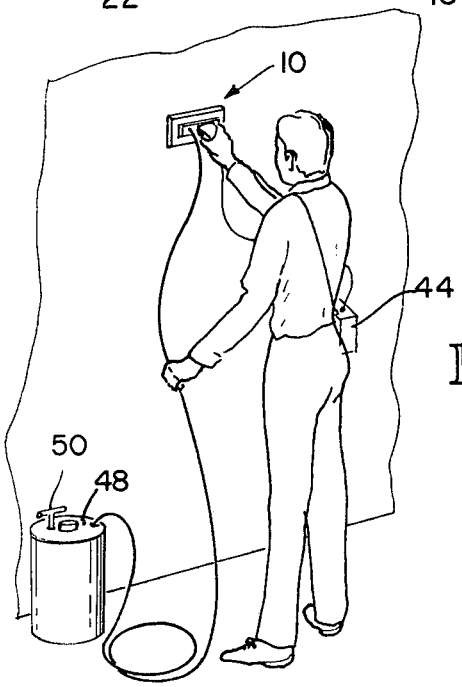
FIG. 6
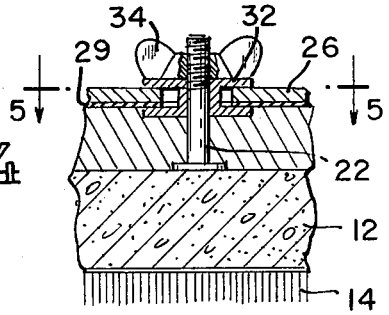
FIG. 4
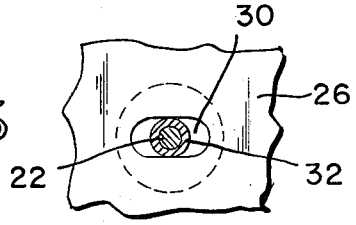
FIG. 5

VIBRATORY PAINT APPLICATOR AND SYSTEM

BACKGROUND OF THE INVENTION

1. Field of the Invention

This invention is directed to a paint applicator and paint applicator system for application of paint to work surfaces, particularly uneven work surfaces.

2. Prior Art Relating to the Disclosure

It is difficult to uniformly coat rough surfaces with an even coat of paint and to insure even application of the paint in corners and other hard to reach places. Paint applicators are currently available which include a pad holder and removable sponge or cellular pad as, for example, those made, manufactured and sold by Padco, Inc. of Minneapolis, Minn. Such applicators are particularly useful with water base paints. Although such applicators perform better than a brush for covering certain work surfaces they are not entirely suitable for application of paint to very rough or uneven surfaces.

Imparting a vibratory or oscillatory motion to pads for cleaning purposes is known. See, for example, U.S. Pat. No. 3,629,893 for a portable vibratory window cleaner; U.S. Pat. No. 3,624,854 for an oscillatory car washer; and U.S. Pat. No. 3,972,088 for an oscillating electric floor scrubber. Imparting vibratory movement to a hairbrush to produce a massaging effect is known. See, for example, U.S. Pat. No. 1,818,281. Use of a paint applicator provided with a cellular pad connected to a pressurized container is also known.

SUMMARY OF THE INVENTION

The principal object of this invention is to provide a paint applicator for application of paint uniformly over a work surface, particularly an uneven work surface.

A further object of this invention is to provide a paint application system for maintaining a smooth continuous flow of paint to an applicator for uniformly coating work surfaces.

A further object of this invention is to provide a paint applicator, including a floating pad to which vibratory or oscillatory motion is imparted, to insure even distribution of paint over a work surface.

These and other objects are accomplished by a paint applicator which comprises a holder for a multi-cellular pad, a manifold secured to the holder, means in the holder for distributing paint delivered to the manifold uniformly over the surface of the pad, means for supplying paint under pressure to the interior of the manifold, and oscillating means adapted to oscillate the pad housed in a housing secured to the manifold.

BRIEF DESCRIPTION OF THE DRAWINGS

FIG. 1 is a perspective view of the paint applicator of this invention;

FIG. 2 is a cross-section along section line 2—2 of FIG. 1;

FIG. 3 is a plan view of the holder for the pad;

FIG. 4 is a partial cross-sectional view of the means of securing the pad holder to the manifold;

FIG. 5 is a cross-sectional view along section line 5—5 of FIG. 4; and FIG. 6 is a schematic illustrating the paint system.

DETAILED DESCRIPTION OF THE INVENTION

FIGS. 1-5 are directed to the paint applicator for uniformly spreading paint or other viscous liquids. FIG. 6 is directed to a paint system utilizing the paint applicator of this invention together with a pressurized container for dispensing paint.

Referring to FIG. 1, the paint applicator 10 has a multi-cellular sponge or pad 12, preferably provided on its lower surface with a brush surface 14. The brush surface is adhered to the multi-cellular sponge or pad. The pad is adhesively bonded or otherwise secured to a pad holder 16 having the same dimensions as the pad. The pad holder has numerous bore openings 18 therein which are angled through the entire width of the holder so as to provide a uniform distribution of paint to the upper surface of the multi-cellular sponge pad. FIG. 2 illustrates one possible configuration of the openings for uniform distribution of the paint over the entire surface of the pad 12. Rather than the bore openings illustrated, the pad holder may be provided with slots or other means of uniformly distributing the paint over the pad. A clip 20 is provided in the center of the pad 12 which functions to engage the arm of the vibrator or oscillator which will be described later.

Near each corner of the pad holder 16 are bolts 22 for securing the pad holder to the manifold. The manifold 24 is best illustrated by reference to FIG. 2. The manifold 24 includes a plate 26 having a raised portion 28 which is secured over the upper surface of the pad holder 16. A sealing gasket 29 may be positioned around the edges of the manifold plate 26 between the plate 26 and the upper surface of pad holder 16 to prevent paint leakage. The pad 12 is secured to the manifold 24 so that it is free to oscillate or vibrate laterally a sufficient amount to insure even paint coverage over a rough surface, eg. $\frac{1}{8}''$ to $\frac{1}{4}''$ full travel. One method of securing the pad holder to the manifold is by providing slots 30 at each corner of the manifold through which the bolts 22 on the pad holder 16 extend. A slidable washer 32 is housed in each slot having an opening therein through which the respective bolts 22 of a pad holder 16 extend. The pad holder is secured to the manifold by wing nuts 34 as illustrated by FIGS. 5 and 6. The pad holder, thus clamped to the manifold, is free to oscillate or vibrate laterally.

A conventional vibrator or oscillator unit enclosed in a housing 38 is secured to the manifold as illustrated in FIG. 1. The type of vibrating or oscillating unit is not critical. It may be either an electric reciprocal vibrator motor or an electric rotary motor provided with an eccentric, or other suitable means. FIG. 1 uses a reciprocal vibrator motor. The terminating end of the arm 36 of the vibrating unit engages in the clip 20 in the pad holder 16 as illustrated in FIG. 2 to impart a vibrating motion to the pad holder 16 and multi-cellular pad 12. The vibrating arm should be sized to withstand the stress to which it will be subjected. The vibrator unit is provided with a power cord 40 and a switch 42. The unit can either be powered by conventional A.C. house current or power provided from a battery pack 44 as illustrated by FIG. 6. A quickly removable line 46 connecting with the manifold 24 supplies paint to the manifold for distribution over the paint pad 12 through the pad holder 16. Paint may be provided by manual means or from a pressurized dispenser as illustrated in FIG. 6. Referring to FIG. 6, the container 48 may be provided with a manual pump 50 or power means for pressurizing the container. The paint under pressure flows through line 46 into the manifold where it is spread through the openings in the pad holder over the pad. A suitable valve or adjustable clamp 52 is provided in line 46 to control the amount of paint flowing to the paint pad.

Vibration of the pad 12 as the unit is moved across a work surface, particularly an uneven or rough work surface, causes the paint to cover even the deepest irregularities in the work surface without the necessity of applying greater amounts of paint to cover the work surface. The unit reduces the painting time, eliminates the necessity of constantly dipping to reload the paint pad and provides a smooth, even flow of paint for a professional finished job. After painting, the paint pad 12 and holder 16 can be removed from the manifold by merely disconnecting the pad holder from the manifold and both the pad holder and manifold easily cleaned for later reuse. Although the paint applicator and system are particularly useful with water based latex paints, other types of paints may be equally well applied.

I claim:

1. A device for spreading paint uniformly over a work surface, comprising:

a manifold having an open end;

a multicellular pad having an upper and lower surface, the lower surface thereof covered with soft bristles for contacting the work surface;

a pad holder secured over the upper surface of the multicellular pad, including connecting means secured to the manifold to allow lateral movement of the pad and pad holder relative to the manifold;

distribution means in the pad holder for spreading paint supplied to the interior of the manifold uniformly over the upper surface of the multicellular pad;

a vibrator unit secured to the manifold having a vibrating arm contacting the pad holder and multicellular pad to impart vibratory lateral movement thereto relative to the manifold;

power means for operating the vibrator unit; and means for supplying paint to the interior of the manifold for distribution to the pad.

2. The device of claim 1 including a housing for the vibrator unit whose outer configuration resembles a handle for the spreading device.

3. The device of claim 1 including means for regulating the amount of paint supplied to the interior of the manifold.

4. The device of claim 1 wherein the power means for operating the vibratory unit is battery powered.

5. The device of claim 1, including a container for the paint, means for pressurizing the paint in the container, at least one conduit connected at one end to the container and at the other end to the manifold of the spreading device for supplying the paint to the manifold.

6. The device of claim 1 wherein the manifold includes a plate secured to the pad holder such that the pad holder is free to oscillate laterally under the influence of the vibratory unit and wherein sealing means are inserted between the manifold and the pad holder to prevent paint leakage.

7. The device of claim 1, including a gasket inserted between the manifold and pad holder to prevent paint leakage.

8. A spreading device for spreading paint uniformly over a work surface comprising:

a multi-cellular pad having an upper and lower surface, the lower surface thereof covered with soft bristles for contacting the work surface, a pad holder secured over the upper surface of the multi-cellular pad, the pad having threaded members extending upwardly;

a plurality of openings extending through the pad holder for distributing paint delivered over the openings over the upper surface of the pad, a manifold having an open end secured over the openings in the pad holder and elongated slots therein with each slot carrying a laterally slidable washer therein, the threaded members of the pad holder extending through the elongated slots;

means threaded on the threaded members of the pad holder for clamping the pad holder and pad to the washers;

means for supplying paint to the interior of the manifold for delivery to the pad through the openings in the pad holder, a vibrator unit including vibrating arm contacting the pad holder and pad for imparting an oscillatory motion to the pad and pad holder relative to the manifold;

a housing for the vibrator unit whose outer configuration resembles a handle, the housing secured to the manifold, means regulating the amount of paint supplied to the interior of the manifold, and container means for holding the paint under pressure for delivery to the paint applicator.

* * * * *